US009856551B2

(12) United States Patent
Alfonsson et al.

(10) Patent No.: US 9,856,551 B2
(45) Date of Patent: Jan. 2, 2018

(54) FERRITIC-AUSTENITIC STAINLESS STEEL

(71) Applicants: OUTOKUMPU STAINLESS AKTIEBOLAG, Stockholm (SE); Siv Liljas, Ekero (SE)

(72) Inventors: Elisabeth Alfonsson, Avesta (SE); Jun Wang, Scottsdale, AZ (US); Mats Liljas, Avesta (SE); Per Johansson, Avesta (SE)

(73) Assignee: OUTOKUMPU STAINLESS AKTIEBOLAG, Stockholm (SE)

( * ) Notice: Subject to any disclaimer, the term of this patent is extended or adjusted under 35 U.S.C. 154(b) by 82 days.

(21) Appl. No.: 14/725,713

(22) Filed: May 29, 2015

(65) Prior Publication Data

US 2015/0259772 A1 Sep. 17, 2015

Related U.S. Application Data

(63) Continuation of application No. 12/654,593, filed on Dec. 23, 2009, now abandoned, which is a (Continued)

(30) Foreign Application Priority Data

Sep. 27, 2000 (SE) ..... 0003448

(51) Int. Cl.
*C22C 38/02* (2006.01)
*C22C 38/06* (2006.01)
(Continued)

(52) U.S. Cl.
CPC ..... *C22C 38/58* (2013.01); *C22C 38/001* (2013.01); *C22C 38/002* (2013.01); *C22C 38/02* (2013.01);
(Continued)

(58) Field of Classification Search
CPC ..... C22C 38/001; C22C 38/002; C22C 38/02; C22C 38/06; C22C 38/42; C22C 38/44;
(Continued)

(56) References Cited

U.S. PATENT DOCUMENTS 2,624,670 A 1/1953 Binder et al. ..... 420/61
3,736,131 A 5/1973 Espy
(Continued)

FOREIGN PATENT DOCUMENTS

GB 760926 A 11/1956

*Primary Examiner* — Keith Walker
*Assistant Examiner* — John A Hevey
(74) *Attorney, Agent, or Firm* — Nixon & Vanderhye P.C.

(57) ABSTRACT

A ferritic-austenitic stainless steel having a microstructure containing 35-65 vol-% ferrite and 35-65 vol-% austenite has a chemical composition which contains in weight-%: 0.005-0.07 C, 0.1-2.0 Si, 3-8 Mn, 19-23 Cr, 0.5-1.7 Ni, optionally Mo and/or W in a total amount of max 1.0 (Mo+W/2), optionally Cu up to max 1.0 Cu, 0.15-0.30 N, balance iron and impurities. The following conditions apply for the chromium and nickel equivalents: $20<Cr_{eq}<24.5$, $10<Ni_{eq}$, where $Cr_{eq}$=Cr+1.5 Si+Mo+2 Ti+0.5 Nb, and $Ni_{eq}$=Ni+0.5 Mn+30 (C+N)+0.5 (Cu+Co).

23 Claims, 4 Drawing Sheets

Related U.S. Application Data continuation of application No. 10/381,673, filed as application No. PCT/SE01/01986 on Sep. 18, 2001, now abandoned.

(51) Int. Cl.

| | |
|---|---|
| ***C22C 38/42*** | (2006.01) |
| ***C22C 38/58*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/00*** | (2006.01) |
| ***C22C 38/54*** | (2006.01) |

(52) U.S. Cl.

CPC ..... *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/005* (2013.01)

(58) Field of Classification Search

CPC ..... C22C 38/46; C22C 38/48; C22C 38/50; C22C 38/54; C22C 38/58; C21D 2211/001; C21D 2211/005

See application file for complete search history.

(56) References Cited

U.S. PATENT DOCUMENTS

| | | | | |
|---|---|---|---|---|
| 4,434,006 | A | 2/1984 | Kato et al. | 420/11 |
| 4,828,630 | A | 5/1989 | Daniels et al. | 148/325 |
| 6,096,441 | A | 8/2000 | Hauser et al. | |

FERRITIC-AUSTENITIC STAINLESS STEEL

This application is a continuation of application Ser. No. 12/654,593 filed Dec. 23, 2009 (abandoned), which is a continuation of application Ser. No. 10/381,673 filed Apr. 24, 2003 (abandoned), which is a 371 of PCT/SE01/01986 filed Sep. 18, 2001, which claims priority to Swedish Patent Application No. 0003448-8 filed Sep. 27, 2000, the entire contents of each of which are hereby incorporated by reference.

TECHNICAL FIELD

The invention relates to a ferritic-austenitic stainless steel having a microstructure which essentially consists of 35-65 vol-% ferrite and 35-65 vol-% austenite.

BACKGROUND OF THE INVENTION

The ferritic-austenitic stainless steels—the duplex steels—combine a high mechanical strength and toughness with good corrosion resistance, particularly as far as stress corrosion is concerned. For the corrosion resistance as well as for mechanical features such as weldability, it is important that the essential constituents of the steel, austenite and ferrite, are well balanced. In modern development of duplex steels, efforts are made to obtain a microstructure which contains 35-65% ferrite and 35-65% austenite. The duplex steels to an increased extent compete with traditional austenitic stainless steels within offshore, paper and pulp industry, chemical industry, and other fields where high strength and corrosion resistance are required. The duplex steels which so far are commercially available are, however, too expensive to find wider use, in spite of the fact that the duplex steels generally contain lower contents of the expensive alloy element nickel than comparable austenitic stainless steels.

DISCLOSURE OF THE INVENTION

It is the purpose of the invention to provide a ferritic austenitic stainless steel of the type mentioned in the above preamble, which steel contains a lower amount of expensive alloy elements than today commercially available duplex steels and austenitic stainless steels having comparable technical features, and which can be manufactured in a way which is advantageous from a process technical point of view. Most of the fields where duplex steels are used today are conceivable and suitable fields of use, i.e. for applications within offshore, paper and pulp industry, chemical industry etc., but above all for applications where the corrosion conditions are milder than where duplex steels are employed today, but where high strength and/or good resistance against stress corrosion is a benefit. The combination of mechanical strength and corrosion resistance also makes the material suitable for light, maintenance-free constructions within the transportation-, building-, and construction fields.

The achievement of a plurality or all of the following effects are other objectives of the invention

- A yield strength ($Rp_{02}$)≥450 MPa at room temperature and ≥300 MPa at 150° C.,
- A microstructure which contains 35-65% ferrite and 35-65% austenite, preferably 35-55% ferrite and 45-65% austenite,

- A good structural stability,
- A good general corrosion resistance and particularly a good stress corrosion resistance,
- A good weldability with very good reformation of austenite in the heat affected zone.

The above objectives can be achieved therein that the steel has a chemical composition which contains in weight-%:

0.005-0.07 C
0.1-2.0 Si
3-8 Mn
19-23 Cr
0.5-1.7 Ni
optionally Mo and/or W in a total amount of max 1.0 (Mo+W/2)
optionally Cu up to max 1.0 Cu
0.15-0.30 N
balance iron and impurities, and that the following conditions shall apply for the ferrite- and austenite formers of the alloy, respectively, i.e. for the chromium and nickel equivalents:

$$20<Cr_{eq}<24.5$$

$$10<Ni_{eq}, \text{ where}$$

$$Cr_{eq}=Cr+1.5Si+Mo+2Ti+0.5Nb$$

$$Ni_{eq}=Ni+0.5Mn+30(C+N)+0.5(Cu+Co)$$

As far as the individual alloy elements, their importance and interaction are concerned, the following applies. Stated alloy contents refer to weight-% if not something else is mentioned.

Carbon contributes to the strength of the steel and it is also a valuable austenite former and shall therefore exist in a minimum amount of 0.005%, preferably at least 0.01%, suitably at least 0.015%. It is, however, time consuming to bring the carbon content down to low levels in connection with the decarburisation of the steel, and it is also expensive because it increases the consumption of reduction agents. I. a. from these reasons, the carbon content should not be less than 0.02%. If the carbon content is high, there is a risk for precipitation of carbides, which can reduce the impact toughness of the steel and the resistance to intercrystalline corrosion. It shall also be considered that carbon has a very small solubility in the ferrite, which means that the carbon content of the steel substantially is collected in the austenitic phase. The carbon content therefore shall be restricted to max 0.07%, preferably to max 0.05%, and suitably to max 0.04%.

Silicon can be used as a reduction agent at the manufacturing of the steel and exists as a residue from the manufacturing of the steel in an amount of at least 0.1%. Silicon has favourable features in the steel to the effect that it strengthens the high temperature strength of the ferrite, which has a significant importance at the manufacturing. Silicon also is a strong ferrite former and participates as such in the stabilisation of the duplex structure and should from these reasons exist in an amount of at least 0.2%, preferably in an amount of at least 0.35%. Silicon, also have some unfavourable features because it pronouncedly reduces the solubility for nitrogen, which shall exist in high amounts, and if the content of silicon is high also the risk of precipitation of undesired intermetallic phases is increased. The silicon content therefore is limited to max 2.0%, preferably to max 1.5%, and suitably to max 1.0%. An optimal silicon content is 0.35-0.80%.

Manganese is an important austenite former and increases the solubility for nitrogen in the steel and shall therefore exist in an amount of at least 3%, preferably at least 4%, suitably at least 4.5%. Manganese, on the other hand, reduces the corrosion resistance of the steel. Moreover it is difficult to decarburise stainless steel melts having high contents of manganese, which means that manganese need to be added after finished decarburisation in the form of comparatively pure and consequently expensive manganese. The steel therefore should not contain more than 8% manganese, preferably max 6% manganese. An optimal content is 4.5-5.5% manganese.

Chromium is the most important element for the achievement of a desired corrosion resistance of the steel. Chromium also is the most important ferrite former of the steel and gives in combination with other ferrite formers and with a balanced content of the austenite formers of the steel a desired duplex character of the steel. If the chromium content is low, there is a risk that the steel will contain martensite and if the chromium content is high, there is a risk of impaired stability against precipitation of intermetallic phases and so called 475°-embrittlement, and an unbalanced phase composition of the steel. From these reasons the chromium content shall be at least 19%, preferably at least 20%, and suitably at least 20.5%, and max 24%, preferably max 23%, suitably max 22.5%. A suitable chromium content is 21.0-22.0%, nominally 21.2-21.8%.

Nickel is a strong austenite former and has a favourable effect on the ductility of the steel and shall therefore exist in an amount of at least 0.5%. Preferably nickel should exist in an amount of at least 0.8%, suitably at least 1.1%. However, the raw material price of nickel often is high and fluctuates, wherefore nickel, according to an aspect of the invention, is substituted by other alloy elements as far as is possible. Nor is more than 1.7% nickel necessary for the stabilisation of the desired duplex structure of the steel in combination with other alloy elements. An optimal nickel content therefore is 1.35-1.70% Ni.

Molybdenum is an element which can be omitted according to a wide aspect of the composition of the steel, i.e. molybdenum is an optional element in the steel of the invention. Molybdenum, however, together with nitrogen has a favourable synergy effect on the corrosion resistance. In view of the high nitrogen content of the steel, the steel therefore should contain at least 0.1% molybdenum, preferably at least 0.15%. Molybdenum, however, is a strong ferrite former, it can stabilize sigma-phase in the microstructure of the steel, and it also has a tendency to segregate. Further, molybdenum is an expensive alloy element. From these reasons the molybdenum content is limited to max 1.0%, preferably to max 0.8%, suitably to max 0.65%. An optimal molybdenum content is 0.15-0.54%. Molybdenum can partly be replaced by the double amount of tungsten, which has properties similar to those of molybdenum. However, at least half of the total amount of Mo+W/2 should consist of molybdenum. In a preferred composition the steel, however, the steel does not contain more than max 0.3 tungsten.

Copper is also an optional element, which can be omitted according to the widest aspect on this element. However, copper is a valuable austenite former and can have a favourable influence on the corrosion resistance in some environments, especially in some acid media, and should therefore exist in an amount of at least 0.1%. On the other hand, there is a risk of precipitation of copper in case of too high contents thereof, wherefore the copper content should be maximized to 1.0%, preferably to max 0.7%. Optimally, the copper content should be at least 0.15, preferably at least 0.25 and max 0.54% in order to balance the favourable and possibly unfavourable effects of copper with reference to the features of the steel.

Nitrogen has a fundamental importance because it is the dominating austenite former of the steel. Nitrogen also contributes to the strength and corrosion resistance of the steel and shall therefore exist in a minimum amount of 0.15%, preferably at least 0.18%. The solubility of nitrogen in the steel, however, is limited. In case of a too high nitrogen content there is a risk of formation of flaws when the steel solidifies, and a risk of formation of pores in connection with welding of the steel. The steel therefore should not contain more than 0.30% nitrogen, preferably max 0.26% nitrogen. An optimal content is 0.20-0.24%.

Boron can optionally exist in the steel as a micro alloying addition up to max 0.005% (50 ppm) in order to improve the hot ductility of the steel. If boron exists as an intentionally added element, it should exist in an amount of at least 0.001% (10 ppm) in order to provide the desired effect with reference to improved hot ductility of the steel.

In a similar way, cerium and/or calcium optionally may exist in the steel in amounts of max 0.03% of each of said elements in order to improve the hot ductility of the steel.

Besides the above mentioned elements, the steel does not essentially contain any further intentionally added elements, but only impurities and iron. Phosphorus is, as in most steels, a non-desired impurity and should preferably not exist in an amount higher than max 0.035%. Sulphur also should be kept at as low as is possible from an economically manufacturing point of view, preferably in an amount of max 0.10%, suitably lower, e.g. max 0.002% in order not to impair the hot ductility of the steel and hence its rollability, which can be a general problem in connection with the duplex steels.

Within the frame of the above mentioned content ranges, the contents of ferrite formers and austenite formers shall be balanced according to the conditions which have been mentioned in the foregoing, in order that the steel shall get a desired, stabile duplex character. Preferably the nickel equivalent, $Ni_{eq}$, should be at least 10.5 and the chromium equivalent at least 21, most advantageously at least 22. Upwards, the nickel equivalent, $Ni_{eq}$, should be limited to max 15, preferably to max 14. Further the chromium equivalent, $Cr_{eq}$, should be at least 21, preferably at least 21.5 and most advantageously at least 22, but can be limited to max 23.5. It is surprising that a steel with chromium- and nickel equivalents related to one another according to the said criteria has a balanced content of ferrite and austenite within above mentioned content rage. Theoretically, the steel because of its alloy composition should contain less or even much less than 35 volume-% ferrite, but measurements carried out through image analyses of the microstructures instead have shown that the steel as a matter of fact contains a stabile content of at least 35 vol-% ferrite and, for several of the tested steels according to the invention, about 50% ferrite. On the basis of these observations one can, according to an aspect on the relations between the chromium- and nickel equivalents, assume that the coordinates of the chromium- and nickel equivalents should lie within the frame of the area A B C D A in the Schaeffler diagram in FIG. 1, the coordinates of said points being the following:

| | $Cr_{eq}$ | $Ni_{eq}$ |
|---|---|---|
| A | 20.8 | 11.8 |
| B | 23.0 | 15.0 |
| C | 24.0 | 14.5 |
| D | 23.0 | 10.4 |

i.e. well to the left of the region which in the Schaeffler diagram conventional is the region of duplex steels. Nevertheless a stabile duplex character of the steel is achieved.

Performed experiments have shown that good results are achieved with steel alloys having compositions the chromium- and nickel equivalents of which lie within the frame of the more restricted area D E F G H D, the coordinates of said points being:

| | $Cr_{eq}$ | $Ni_{eq}$ |
|---|---|---|
| D | 23.0 | 10.4 |
| E | 22.0 | 11.0 |
| F | 22.0 | 13.5 |
| G | 22.3 | 14.0 |
| H | 23.0 | 14.0 |

BRIEF DESCRIPTION OF DRAWINGS

In the following description of performed experiments, reference will be made to the accompanying drawings, in which.

DESCRIPTION OF PERFORMED EXPERIMENTS AND ACHIEVED RESULTS

The chemical compositions in weight-% of examined steels are given in Table 1. Besides the elements stated in the table, the steels only contained iron and other impurities than the stated ones in normal amounts. The steels V250-V260 were manufactured in the form of 30 kg laboratory heats. Ref. A is a commercially available steel, the composition of which has been analysed by the applicant.

TABLE 1

Composition, weight- %, of examined steels

| | Heat | | | | | | | | | | |
|---|---|---|---|---|---|---|---|---|---|---|---|
| steel | C | Si | Mn | P | S | Cr | Ni | Mo | Ti | Nb | Cu |
| V250 | 0.042 | 0.29 | 4.40 | 0.012 | 0.003 | 21.85 | 1.50 | 0.32 | 0.003 | 0.001 | 0.18 |
| V251 | 0.052 | 0.30 | 5.26 | 0.012 | 0.004 | 21.52 | 1.48 | 0.32 | 0.004 | 0.001 | 0.18 |
| V252 | 0.032 | 0.30 | 5.16 | 0.012 | 0.004 | 21.80 | 1.49 | 0.32 | 0.002 | 0.001 | 0.22 |
| V254 | 0.036 | 0.39 | 5.23 | 0.012 | 0.004 | 21.24 | 1.10 | 0.13 | 0.005 | 0.001 | 0.41 |
| V258 | 0.018 | 0.28 | 5.22 | 0.008 | 0.002 | 21.63 | 1.49 | 0.32 | 0.003 | 0.002 | 0.88 |
| V260 | 0.038 | 0.31 | 4.71 | 0.008 | 0.003 | 21.77 | 1.50 | 0.32 | 0.004 | 0.001 | 0.24 |
| Ref. A | 0.026 | 0.39 | 5.17 | 0.026 | 0.001 | 20.90 | 1.25 | 0.08 | 0.019 | 0.004 | 0.44 |

| | Heat | | | | | | | |
|---|---|---|---|---|---|---|---|---|
| steel | N | W | V | Al | B | O | $Cr_{eq}$ | $Ni_{eq}$ |
| V250 | 0.245 | <0.01 | 0.035 | 0.17 | 0.0004 | n.a.* | 22.6 | 12.4 |
| V251 | 0.225 | <0.01 | 0.034 | 0.016 | 0.0004 | n.a.* | 22.3 | 12.5 |
| V252 | 0.285 | <0.01 | 0.035 | 0.001 | 0.0005 | 0.0125 | 22.6 | 13.7 |
| V254 | 0.130 | <0.01 | 0.035 | 0.014 | <0.001 | n.a.* | 21.9 | 8.9 |
| V258 | 0.203 | 0 | 0.025 | 0.024 | 0.0004 | 0.0036 | 22.4 | 11.1 |
| V260 | 0.227 | 0 | 0.024 | 0.025 | 0.0003 | 0.0017 | 22.6 | 11.9 |
| Ref. A | 0.127 | <0.01 | 0.068 | <0.001 | 0.0041 | n.a.* | 21.6 | 8.5 |

*n.a. = not analyzed

Mechanical Tests

The laboratory heats were rolled to the shape of 3 mm thick, narrow plates, which were used for the mechanical tests. By experience it is known that the 0.2 yield strength lies at a 80-100 MPa lower level than for materials which have been manufactured at a full production scale. The 0.2- and 1.0 yield strengths, the ultimate strength (Rm), the elongation in tensile test ($A_5$) and the Brinell hardness were examined at room temperature, 20° C., and at 150° C. Representative measurements are given in Table 2.

TABLE 2

Mechanical strength features at 20° C. and 150° C.

| | Heat | | | | | |
|---|---|---|---|---|---|---|
| steel | Temp ° C. | $Rp_{0.2}$ MPa | $Rp_{1.0}$ MPa | Rm MPa | $A_5$ % | HB |
| V258 | 20 | 465 | 525 | 686 | 46 | 210 |
| | 150 | 352 | 397 | 596 | 44 | — |
| V260 | 20 | 470 | 526 | 694 | 46 | 209 |
| | 150 | 352 | 399 | 602 | 42 | — |
| V254 | 20 | 440 | 504 | 644 | 39 | 211 |
| | 150 | 338 | 387 | 548 | 36 | — |

Microstructure Studies

Figure 1:
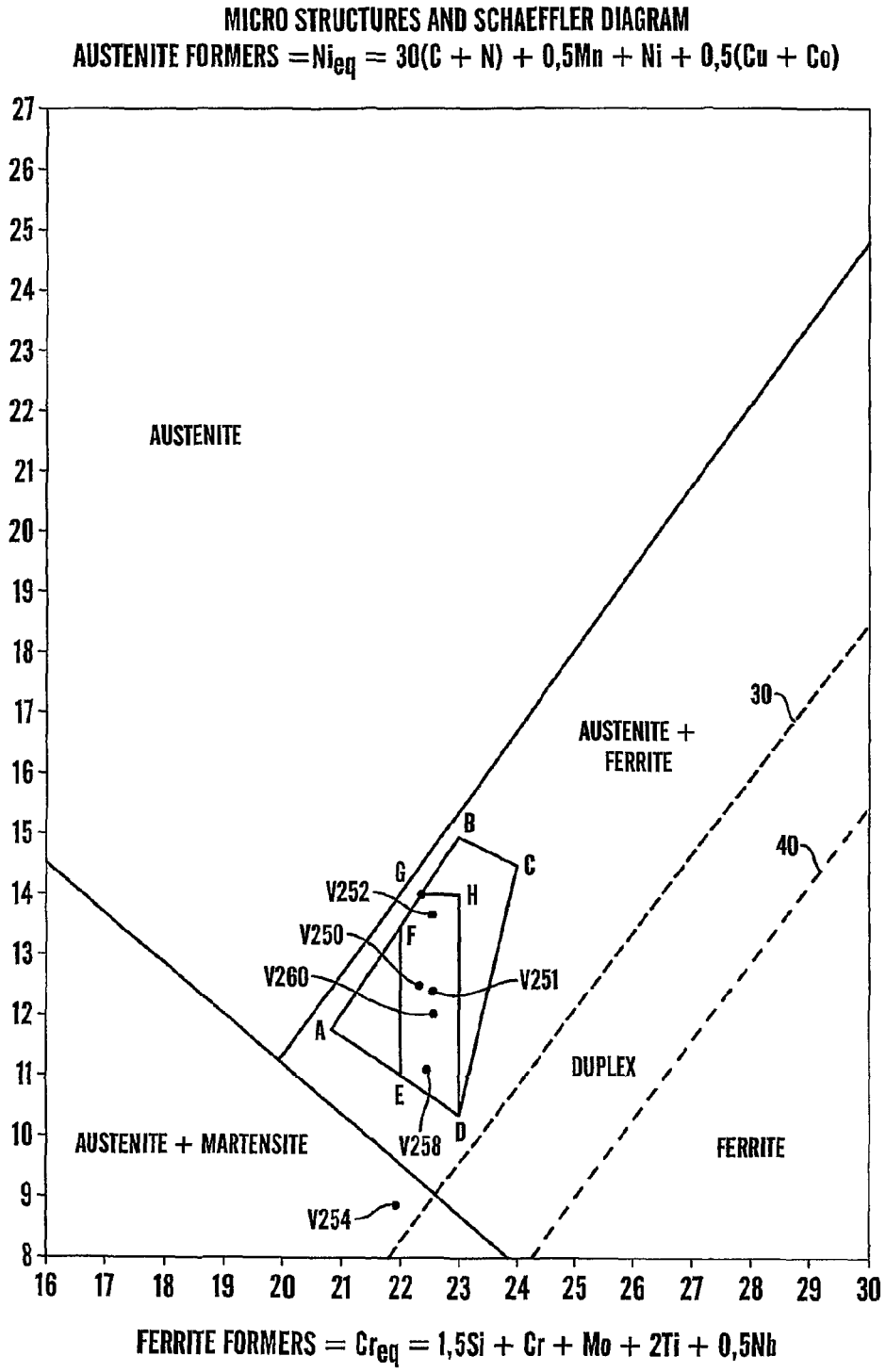
FIG. 1 shows microstructures and a Schaeffler diagram, illustrating the theoretical chromium- and nickel equivalents according to the invention.
Figure 2:
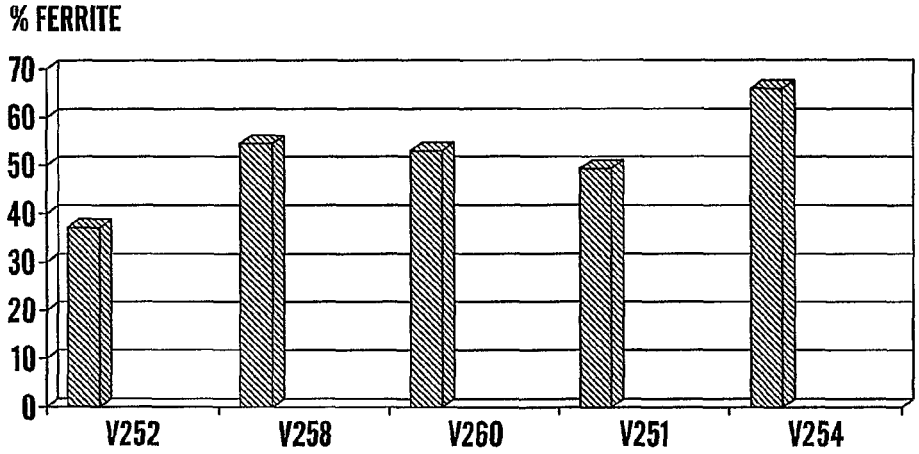
FIG. 2 is a bar chart which illustrates the real ferrite and austenite contents which have been measured in examined steels according to the invention.

In the Schaeffler diagram in FIG. 1 the coordinates of the steels V250-V260 manufactured at a laboratory scale have been inserted. All these coordinates lie within the ferritic-austenitic structure area of the diagram but to the left of the line representing the ferrite number 30, wherefore the steels should not be duplex steels. Test measuring of the manufactured steels, performed through image analyses of the microstructures, however, surprisingly shows that at least the steels V251-V260 contain more than 35 vol-% ferrite, as is shown by the chart diagram in FIG. 2. The examined test specimens had been solution heat treated through annealing at 1.050° C. The structure stability was comparable with that of the steel of the applicant having the trade name SAF 2304™, which is a duplex steel corresponding UNS S32304.

Corrosion Tests

Figure 3:
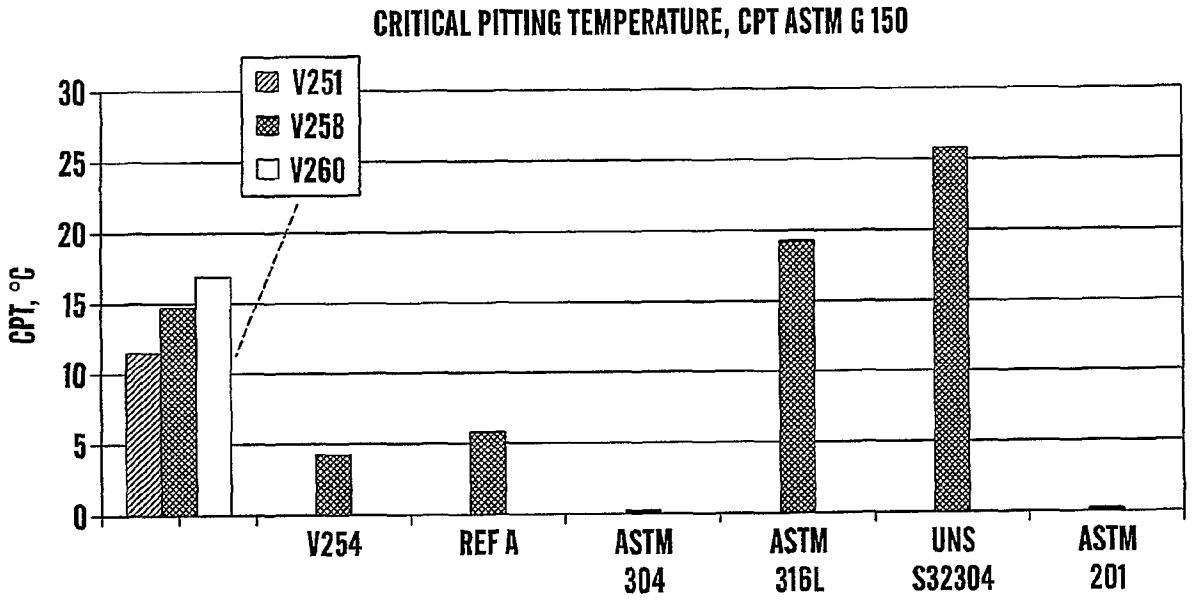
FIG. 3 is a bar chart illustrating the resistance to pitting corrosion of examined steels in the form of measured critical pitting temperatures, CPT.

The critical pitting temperature, CPT, was determined according to the standardized method which is known by the designation ASTM G 150. The results are represented by the chart diagram in FIG. 3. The test shows that the steels V251, V258, and V260 manufactured at a laboratory scale have a significantly better corrosion resistance than V254 and also essentially better than the reference steels Ref. A, ASTM 304 and ASTM 201, but the steels of the invention manufactured at a laboratory scale do not reach the level of ASTM 316 L or UNS S 32304, which however, have a higher content of expensive alloy metals.

Two methods were employed for measuring the resistance to intercrystalline corrosion. Specimens which had been sensitized for 1 h at 700° C. or for 8 h at 600° C. and 800° C., respectively, were tested in a sulphuric acid/copper sulphate solution according to EN-ISO 3651-2, method A (Strauss test). No test specimen showed any signs of intercrystalline corrosion. Nor did testing according to the more aggressive method EN-ISO 3651-2, method C (Streicher test) of solution heat treated tests specimens or of specimens sensitized at 700° C. for 30 min, respectively, result in intercrystalline corrosion.

Figure 4:
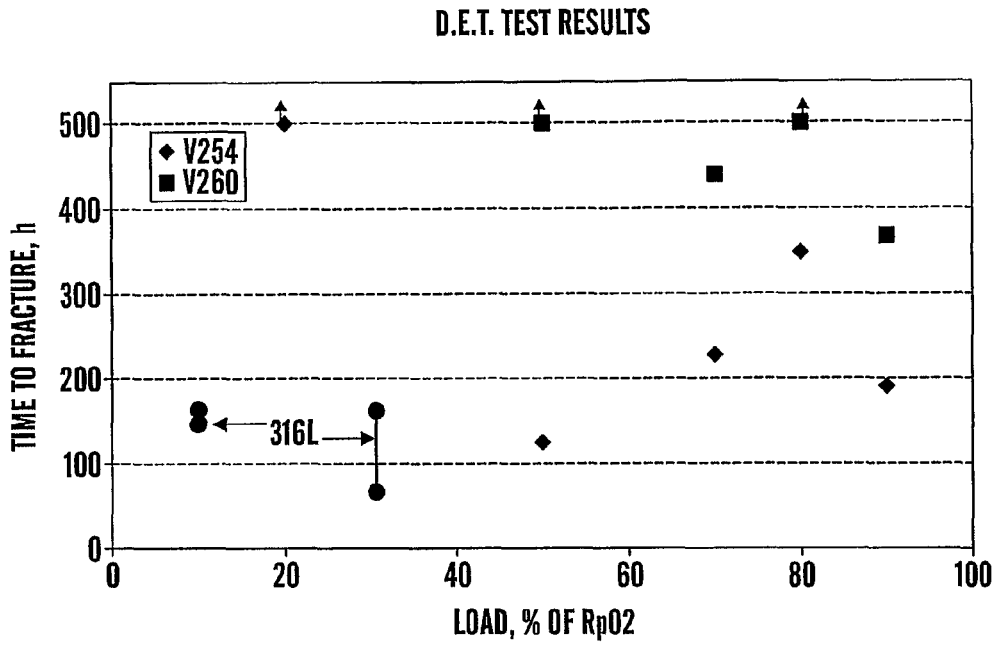
FIG. 4 is a diagram illustrating the resistance to stress corrosion versus time to fracture at drop evaporation testing of a number of examined alloys.

The resistance to stress corrosion was studied according to the drop evaporation test (DET) described e.g. in MTI manual No. 3, method MTA-5. A mono-axially loaded, resistance heated test specimen was exposed to a dripping sodium chloride solution. The time to fracture was determined at different load levels, defined as a certain proportion of Rp02 at 200° C. The results for the experimental heats V260 and V254 are shown in FIG. 4 together with data for the austenitic steel ASTM 316L. Like commercially available duplex steels, the experimental heats exhibited an essentially higher resistance to stress corrosion than standardized austenitic steels, such as ASTM 316L, V260 appears to be more resistant that V254.

In summary it can as far as the corrosion resistance is concerned be stated that the pitting corrosion resistance is essentially higher than for the austenitic steel ASTM 304, that no intercrystallin corrosion could be observed, and that also the stress corrosion resistance is essentially higher than for conventional austenitic steels.

Weldability Tests

Weldability tests were carried out by TIG-welding of a plate without addition of a filler metal, and by TIG-welding in a weld joint using a filler metal of type AWS ER 2209, which is a ferritic austenitic filler material which usually is used for welding more highly alloyed duplex steels. The ferrite contents in the latter case were measured in the weld and in the heat affected zone.

Figure 5:
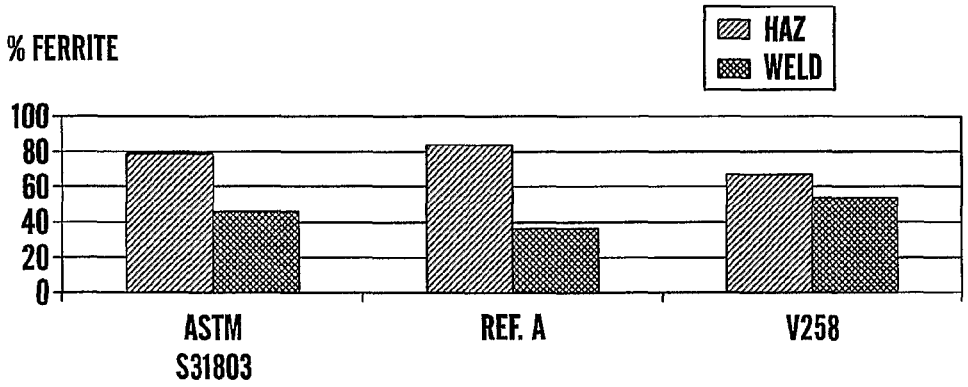
FIG. 5 is a bar charge illustrating the weldability of a number of examined alloys in terms of ferrite content in the heat effected zone (HAZ) and in the welding seam itself.

The weldability of the test alloys was comparable to that of the reference material Ref. A and UNS S 31803. Non destructive testing with x-ray controls could not detect any high porosity levels. The material of the invention had a high degree of austenite reformation in the heat affected zone, HAZ, and in the weld in comparison with the reference material Ref. A and UNS S 31803. The ferrite content in the case of manual TIG welding a steel of type UNS S 31803, the reference steel Ref. A, and the steel V258 of the invention with a filler metal of type AWS ER2209 is shown in the bar chart in FIG. 5. When subjected to tensile testing, all the welds were fractured in the parent material and not in the welds.

On the basis of the experiences derived through the testing of laboratory scale materials which have been described in the foregoing, a 90 tons heat No. 804030 was manufactured having the following chemical composition in weight-%, Table 3. Besides the elements mentioned in Table 3, the steel only contained iron and other impurities than those which are stated in the Table in normal amounts.

TABLE 3

Chemical composition, weight- %, Heat No. 804030

| C | Si | Mn | P | S | Cr | Ni | Mo | Ti |
|---|---|---|---|---|---|---|---|---|
| 0.024 | 0.69 | 5.07 | 0.017 | 0.000 | 21.36 | 1.49 | 0.30 | 0.00 |
| **Nb** | **Cu** | **N** | **As** | **W** | **V** | **Al** | **B** | **O** |
| 0.001 | 0.32 | 0.232 | 0.004 | 0.00 | 0.052 | 0.008 | 0.0021 | 0.0014 |

A strand was made through continuous casting of the molten steel. The strand was cut into slabs. Some slabs were hot rolled to the shape of plates having thicknesses of 8 mm and 15 mm respectively, while other slabs were hot-rolled to the form of coils having a thickness of 4 mm. Some of the hot-rolled coils were further cold rolled to thicknesses of 3 mm, 1.5 mm and 1.0 mm, respectively. Test specimens were taken from different parts of the plates and coils respectively. The mechanical properties of the hot rolled, 4 mm thick coil were tested at 20° C. The results of the tests (mean values) are given in Table 4.

TABLE 4

Mechanical properties at 20° C., solution annealed condition, T = 1.050° C.

| $Rp_{0.2}$ MPa | $Rp_{1.0}$ MPa | Rm MPa | $A_5$ % | HB |
|---|---|---|---|---|
| 558 | 625 | 775 | 37 | 230 |

The tests demonstrated that the steel which is produced at a production scale is stronger than the materials which are produced at a laboratory scale. The elongation value corresponded well with the results from the laboratory tests, and the hardness was at a somewhat higher level than for the laboratory scale materials, which harmonizes with the higher yield and ultimate strength.

Test specimens of the materials that were hot rolled and hot rolled+cold rolled, respectively, were also subjected to pitting corrosion tests according to ASTM G 150. The plates of gauge 8 and 15 mm had a critical pitting temperature, CPT, of 17° C., while the coils whether they were cold rolled or not had a critical pitting temperature of 22° C. The results indicate that the production material also had an improved pitting corrosion resistance as compared with the laboratory materials.

The invention claimed is:

1. A ferritic-austenitic stainless steel having a microstructure which essentially consists of 35-65 vol-% ferrite and 35-65 vol-% austenite, wherein the steel has a chemical composition which contains in weight-%:

0.02-0.07 C
0.35-1.0 Si
3-8 Mn
21-22 Cr
1.35-1.7 Ni
At least 0.1 Mo
optionally W in a total amount of max 1.0 (Mo+W/2)
Cu up to max 1.0 Cu
optionally up to 0.03 of each Ce and/or Ca
0.024-0.035 V
0.18-0.30 N
0.002-0.005 Ti
0.001-0.002 Nb
0.001-0.17 Al
0.003-<0.001 B
0.002-0.004 S
0.008-0.012 P
balance iron and impurities, wherein the following conditions apply for the ferrite and austenite formers of the alloy, respectively, i. e. for the chromium and nickel equivalents:

$$22<Cr_{eq}<24.5$$

$$10.4<Ni_{eq}<14$$

where $$Cr_{eq}=Cr+1.5\ Si+Mo+2\ Ti+0.5\ Nb$$

$$Ni_{eq}=Ni+0.5\ Mn+30(C+N)+0.5(Cu+Co)\ \text{and}$$

wherein the coordinates of the Cr—Ni-equivalents lie within the frame of the area of points D E F G H D in the Schaeffler diagram in FIG. 1, the coordinates of said points being:

| | Creq | Nieq |
|---|---|---|
| D | 23.0 | 10.4 |
| E | 22.0 | 11.0 |
| F | 22.0. | 13.5 |
| G | 22.3 | 14.0 |
| H | 23.0 | 14.0 |

and wherein the $Cr_{eq}/Ni_{eq}$ is within the range 1.53-2.21, and the critical pitting temperature is between 17° C. and 22° C., and the yield strength Rp0.2 is 440-470 MPa at room temperature and the elongation ($A_5$) is 39-46% at room temperature.

2. A steel according to claim 1, wherein it contains max 0.05 C.

3. A steel according to claim 1, wherein it contains max 0.04 C.

4. A steel according to claim 1, wherein it contains 0.35-0.80 Si.

5. A steel according to claim 1, wherein it contains at least 4 Mn.

6. A steel according to claim 1, wherein it contains at least 4.5 Mn.

7. A steel according to claim 1, wherein it contains max 6 Mn.

8. A steel according to claim 6, wherein it contains 4.5-5.5 Mn.

9. A steel according to claim 1, wherein it contains 21.2-21.8 Cr.

10. A steel according to claim 1, wherein it contains at least 0.15 Mo.

11. A steel according to claim 1, where it contains max 0.8 Mo.

12. A steel according to claim 1, where it contains max 0.65 Mo.

13. A steel according to claim 1, wherein it contains 0.15-0.54 (Mo+W/2).

14. A steel according to claim 1, wherein it contains at least 0.1 Cu.

15. A steel according to claim 1, wherein it contains at least 0.15 Cu.

16. A steel according to claim 1, wherein it contains at least 0.24 Cu.

17. A steel according to claim 14, wherein it contains max 0.7 Cu.

18. A steel according to claim 14, wherein it contains 0.25-0.54 Cu.

19. A steel according to claim 1, wherein it contains 0.18 N.

20. A steel according to claim 1, wherein it contains max 0.26 N.

21. A steel according to claim 20, wherein it contains 0.20-0.24 N.

22. A steel according to claim 1, wherein it contains max 0.002 S.

23. A ferritic-austenitic stainless steel having a microstructure which consists essentially of 35-65 vol-% ferrite and 35-65 vol-% austenite, wherein the steel has a chemical composition which contains in weight-%:

0.02-0.07 C
0.35-1.0 Si
3-8 Mn
21-22 Cr
1.35-1.7 Ni
at least 0.1 Mo
optionally W in a total amount of max 1.0 (Mo+W/2)
Cu up to max 1.0 Cu
optionally up to 0.03 of each Ce and/or Ca
0.024-0.035 V
0.18-0.30 N
0.001-0.005 B
0.002-0.005 Ti
0.001-0.002 Nb
0.001-0.17 Al
0.002-0.004 S
0.008-0.012 P
balance iron and impurities, wherein the following conditions apply for the ferrite and austenite formers of the alloy, respectively, i. e. for the chromium and nickel equivalents:

$$22<Cr_{eq}<24.5$$

$$10.4<Ni_{eq}<14$$

where $$Cr_{eq}=Cr+1.5\ Si+Mo+2\ Ti+0.5\ Nb$$

$$Ni_{eq}=Ni+0.5\ Mn+30(C+N)+0.5(Cu+Co)\ \text{and}$$

wherein the coordinates of the Cr—Ni-equivalents lie within the frame of the area of points D E F G H D in the Schaeffler diagram in FIG. 1, the coordinates of said points being:

| | Creq | Nieq |
|---|---|---|
| D | 23.0 | 10.4 |
| E | 22.0 | 11.0 |
| F | 22.0. | 13.5 |
| G | 22.3 | 14.0 |
| H | 23.0 | 14.0 |

and wherein the $Cr_{eq}/Ni_{eq}$ is within the range 1.53-2.21, and the critical pitting temperature is between 17° C. and 22° C., and the yield strength Rp0.2 is 440-470 MPa at room temperature and the elongation ($A_5$) is 39-46% at room temperature.

* * * * *